US005927196A

United States Patent [19]

Murray

[11] Patent Number: 5,927,196

[45] Date of Patent: Jul. 27, 1999

[54] POST CHILL DANCER ROLL

[75] Inventor: Robert R. Murray, Madbury, N.H.

[73] Assignee: Heidelberger Druckmaschinen, Heidelberg, Germany

[21] Appl. No.: 08/899,615

[22] Filed: Jul. 24, 1997

[51] Int. Cl.[6] ..... B41F 5/04

[52] U.S. Cl. ..... 101/219; 101/225; 226/25; 226/45

[58] Field of Search ..... 101/219, 225, 101/226, 227, 228; 270/41; 156/248; 226/25, 45, 14

[56] References Cited

U.S. PATENT DOCUMENTS

| | | | |
|---|---|---|---|
| 3,032,245 | 5/1962 | George et al. | 101/219 |
| 3,556,510 | 1/1971 | Treff | 270/41 |
| 3,975,559 | 8/1976 | Paulson et al. | 156/248 |
| 4,366,753 | 1/1983 | Glanz et al. | 101/227 |
| 4,452,140 | 6/1984 | Isherwood et al. | 101/248 |
| 5,024,156 | 6/1991 | Hank et al. | 401/216 |
| 5,361,960 | 11/1994 | Fokos et al. | 226/27 |
| 5,647,276 | 7/1997 | Tilton, Sr. | 101/219 |

*Primary Examiner*—Eugene Eickholt
*Attorney, Agent, or Firm*—Kenyon & Kenyon

[57] ABSTRACT

A device for controlling the tension in a web of a printing press includes an adjustably positionable dancer roll coupled to an air cylinder. The dancer roll engages the web at a position subsequent to the chill exit nip rolls and prior to a next nip roll pair, e.g., the slitter unit entrance nip rolls. The air cylinder applies a biasing force on the dancer roll to maintain contact between the dancer roll and the web. A control device is coupled between the dancer roll and the next nip roll pair. The control device monitors the position of the dancer roll and increases or decreases the speed of the next nip roll pair based on the direction and magnitude of the dancer roll movement. In this manner, the tension in the web is kept substantially constant between the chill exit nip rolls and the next nip roll pair.

11 Claims, 5 Drawing Sheets

POST CHILL DANCER ROLL

FIELD OF THE INVENTION

The present invention relates to tension control systems and more particularly to a device for controlling tension of a material web in a post chill region of a printing press.

BACKGROUND OF THE INVENTION

In web printing presses, a continuous web of paper is fed through the press. The web travels through various components of the press by passing over both driven and idle rolls. The rolls guide the web through the press, the driven rolls providing motive force and the idler rolls providing position, guidance and direction.

A web printing press typically includes a plurality of processing units. These units may include the printing units, dryer unit, chill unit, and slitter unit. Each printing unit generally prints a separate color onto the web in order to create a color print. For example, in a printing press with four printing units, a first printing unit could print black, a second printing unit could print cyan, a third printing unit could print magenta, and a fourth printing unit could print yellow. The web travels through the nip of each printing unit as the web traverses from print unit to print unit. After the web traverses through the nip of the last printing unit, the web will enter entrance nip rolls of a following processing unit, such as for example, the chill unit.

A pair of nip rolls is a pair of cylindrical rolls arranged with their axes substantially parallel to one another. The circumferential surfaces of the nip rolls are in rolling engagement with each other, the material web passing between the nip rolls in a path approximately perpendicular to the plane of the two parallel axes of the rolls. The traversing surface speed of the web is approximately equal to the circumferential surface speed of the nip rolls.

However, if two pairs of nip rolls rotate such that the circumferential speed of a first pair of nip rolls is different from the circumferential speed of a second pair of nip rolls, or if slippage occurs between the nip rolls and the web, tension or slack may develop in the web. The web is considered to be in tension, or to be taut, when there has been a change in length of 0.1% or more. The web is considered to be slack, or baggy, when the length of a portion of the web extending between two points exceeds a standard amount by, for example, 0.1% or more. Other criteria may of course be used to define a web as being in tension or slack. The criteria described above is based on a 100% safety factor by using the observation that certain types of paper will tear when stretched in excess of 0.2% of its original length.

When a first pair of nip rolls through which the web passes are turning at a faster circumferential speed than a subsequent pair of nip rolls, it is possible that a 0.1% reduction in length of the web will occur, thus resulting in a slack web. When slack exists in the web, the condition may also be referred to as having a baggy web.

Alternatively, when the first pair of nip rolls is rotating more slowly than the subsequent pair of nip rolls, tension will build in the web. Such tension in the web may cause slippage between the rolls and the web. If the tension builds to a high enough level, failure or tearing of the web may occur. If the web fails or tears, the press must be shut down, the torn portion of the web must be removed, and the web must be rethreaded through the press, resulting in expensive down time and loss of operation.

Conventionally, after a web passes through the printing units and through the dryer unit, the web moves through a chill unit and then to a slitter unit. The chill unit is the first unit the web contacts via a nip after exiting the dryer unit of the printing press.

One purpose of the chill unit is to cool down the heated web prior to further processing in the press. The chill unit includes a plurality of chill rolls which operate to cool down the web. The last of the chill rolls is coupled with a further roll to form a pair of chill unit exit nip rolls. Because the dryer unit typically does not contain a set of nip rolls, a second purpose of the chill unit is to pull the web through the dryer unit.

A series of fixed position idler rolls have generally been positioned between the chill unit exit nip rolls and the slitter unit entrance nip rolls located at the entrance to the slitter. These idler rolls rotate freely about fixed axes. Contact with the web provides the motive force to rotate the idler rolls about their axes.

One disadvantage of this design is that the idler rolls relieve tension only by allowing slippage between the rolls and the web. Only a limited amount of tension can be relieved in this way. Another problem is that idler rolls are not capable of taking slack out of baggy webs.

Several attempts have been made to reduce or eliminate baggy webs and broken webs, but none have adequately solved the problem. One attempted solution was to use motor driven tension control systems that attempt to maintain tension control over the web by adjusting motor speed on driven rolls to either increase or decrease the feed rate of specific rolls. Slowing down the motor decreases the feed rate, thereby eliminating a baggy web down stream. Increasing the motor rate reduces down stream tension to prevent a web from breaking. Conceptually, this solution is sound, however, in practice, the response time of these motor driven tension control systems is too great to alleviate the baggy and broken web conditions before problems arise. In addition, known variable speed motor driven tension control systems are inadequate to effectively remove baggy webs or high tension webs during the press start up period when the requirement for dynamic response high.

Dancer rolls have been employed to control tension and baggy webs after the intake feeds of offset printing presses. The intake feed of these systems, located between the roll stand and the first printing unit, controls delivery of the web to the first printing unit to maintain a positive tension in the web as it enters the first printing unit. Dancer rolls have been provided between the roll stand and the intake feed to maintain a constant web tension after the intake feed, or between the intake feed and the first print unit to maintain a constant web tension at the first printing unit. However, dancer rolls typically are not applied to the post chill region of a printing press in part because of concerns about cutoff control. Cutoff control refers to maintaining control over the speed and position of the web, specifically with relation to the location of the printed image so that the web may be cut into signatures in the nonprinted region. A dancer roll causes dynamic changes in the path length of the web. Placing a dancer roll downstream of the print units changes the path length of the web upon which an image has been printed which raises concerns about maintaining cutoff control.

SUMMARY OF THE INVENTION

In accordance with the present invention, a device for controlling the tension in a web of a printing press includes an adjustably positionable dancer roll coupled to an air cylinder to engage the web downstream of the chill unit exit nip rolls and prior to a next nip roll pair, for example, the slitter unit entrance nip rolls. The air cylinder applies a constant force to the dancer roll while a control device, coupled between the air cylinder and the next nip roll pair, monitors the position of the dancer roll. In response to dancer roll movement indicative of slack in the web, the control device increases the speed of the next nip roll pair to take up the slack. Conversely, in response to dancer roll movement indicative of a decrease in web length between the chill unit exit nip rolls and the next unit nip rolls, the control device decreases the speed of the next nip roll pair. In this manner, the tension in the web is kept substantially constant between the chill unit exit nip rolls and the next nip roll pair. It is noted that the same principle, albeit with a reversal of whether the speed is increased or decreased, may be applied to a control scheme in which the speed of the chill unit exit nip rolls, rather than the speed of the next unit nip rolls, is changed as governed by the dancer roll position. By maintaining a web in a taut condition, and maintaining control over the position of the dancer roll, slack or baggy webs may be avoided and cutoff control can be maintained.

In accordance with a first embodiment of the present invention, the dancer roll translates along an arc having a radius defmed by two substantially parallel lever arms—one lever arm rotatably attached at each end of the dancer roll's axis of rotation. The other end of each lever arm is rotatably attached to the frame of the press. Two substantially parallel air cylinders are rotatably attached to the dancer roll—one air cylinder at each end of the dancer roll—at the dancer roll's axis of rotation. The other end of each air cylinder is rotatably connected to a position of the frame different from the position of attachment of the lever arms. One embodiment provides a 90 degree angle between the lever arm and air cylinder where they attach at the dancer roll's axis of rotation. Other relative angles between the lever arms and air cylinders are operable. Whatever the relative angle, this configuration provides that the dancer roll translates along an arc, whose radius is the lever arm, as the air cylinders extend and retract in response to forces exerted by the web on the dancer. Another advantageous configuration provides that the arc of the dancer roll is in a roughly horizontal plane. Such a configuration helps minimize the effects of gravity on the dancer roll's mass.

In accordance with a second embodiment of the present invention, the dancer roll translates linearly. The linear path is governed by two substantially parallel air cylinders, one air cylinder attached to each end of the dancer roll. The other end of each air cylinder is fixedly attached to the frame of the press in a manner that does not permit rotation of the air cylinder. Thus, the air cylinders' shaft extends and retracts in a linear motion, which governs the linear translation of the dancer roll. It is appreciated that the dancer roll may be supported at each end by sliding supports attached to the frame to facilitate linear translation. It is conceivable, with the use of sliding supports to guide the dancer roll's linear movement, to use various configurations in which a single or multiple air cylinders are used to affect the dancer roll's movement.

In accordance with the present invention, when the speed of the portion of the web exiting the chill unit matches the speed of the portion of the web entering the slitter unit, the air cylinder and dancer roll will reside in a neutral position. However, when a speed differential forms between the portion of the web exiting the chill unit and the portion of the web entering the slitter unit, the air cylinder extends or retracts as necessary to change the position of the dancer roll to maintain a constant tension in the web. The change in position of the dancer roll is detected by the control unit, which, in turn, increases or decreases the speed of the slitter unit entrance nip rolls accordingly. Changing the speed of the slitter unit entrance nip rolls returns the dancer roll to its neutral position. When the dancer roll returns and stays in its neutral position, the speed of the portion of the web exiting the chill unit substantially matches the speed of the portion of the web entering the slitter unit. The changes in position of the dancer roll and resulting adjustments to the speeds of the nip rolls occur while maintaining an essentially constant tension in the web.

DETAILED DESCRIPTION OF THE INVENTION

The present invention is directed to a device for controlling tension in the web of a printing press.

Figure 1:
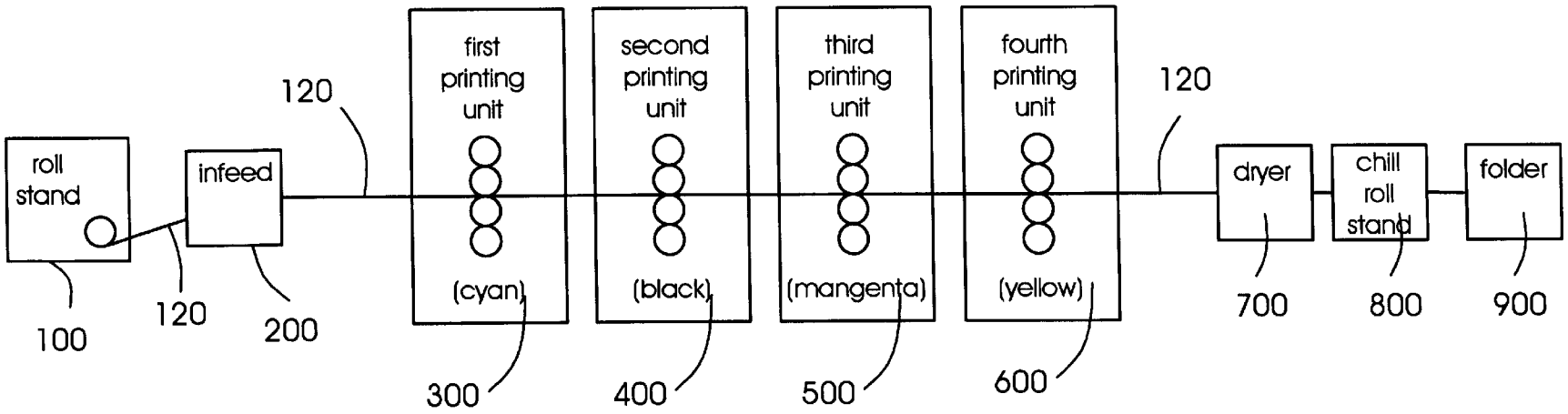
Fig. 1 PRIOR ART
FIG. 1 illustrates a conventional printing press.

FIG. 1 shows a conventional printing press including a roll stand 100, an infeed 200, a first printing unit 300, a second printing unit 300, a third printing unit 500, a fourth printing unit 600, a dryer unit 700, a chill roll stand 800, and a folder 900. A roll of paper 110, which comprises the web 120, is located in the roll stand 100. The web 120 travels from the roll stand to the infeed where it travels through an infeed nip and around an infeed dancer roll. The web then travels to the first printing unit 300 which prints, for example, the color black onto the web. The web then enters the second printing unit 400 (printing cyan), the third printing unit 500 (printing magenta), and the fourth printing unit 600 (printing yellow).

After exiting the fourth printing unit 600, the web enters the dryer 700. The dryer 700 dries the web by applying heat to the web. Since the web expands or contracts in length and loses moisture as it is heated, the tension of the web may change as it exits the dryer 700 and enters the chill roll stand 800. The chill roll stand 800 includes a plurality of chill rolls which pull the web from the dryer 700 and simultaneously cool the web as it passes through the chill rolls. Typically, each of the plurality of chill rolls are driven simultaneously, for example, by a belt drive system. If the web should become longer due to yielding or improper take up by the chill unit, the dryer may blow the excess web into a curved path, thus maintaining a positive tension in the web. Since the web tends to contract as it passes through the chill rolls, the tension in the web may once again change.

In prior art systems, as the web leaves the chill unit exit nip rolls, it passes through a plurality of idler rolls and control rolls before entering the slitter unit entrance nip rolls located in the folder unit 900. The idler and control rolls may be used, for example, to steer the web, apply silicone to the web, or control the length to the cut off point As explained above, idler rolls cannot alleviate a baggy web condition, and moreover, have a very limited effect in relieving web tension.

In contrast, in accordance with the present invention, a dancer roll assembly is provided between the chill unit exit nip rolls and the slitter unit entrance nip rolls. The dancer roll assembly has a dancer roll mounted so that it may move relative to the printing press apparatus, and a force biasing element, such as an air cylinder, which provides a force to maintain the dancer roll in contact with the web.

Figure 2:
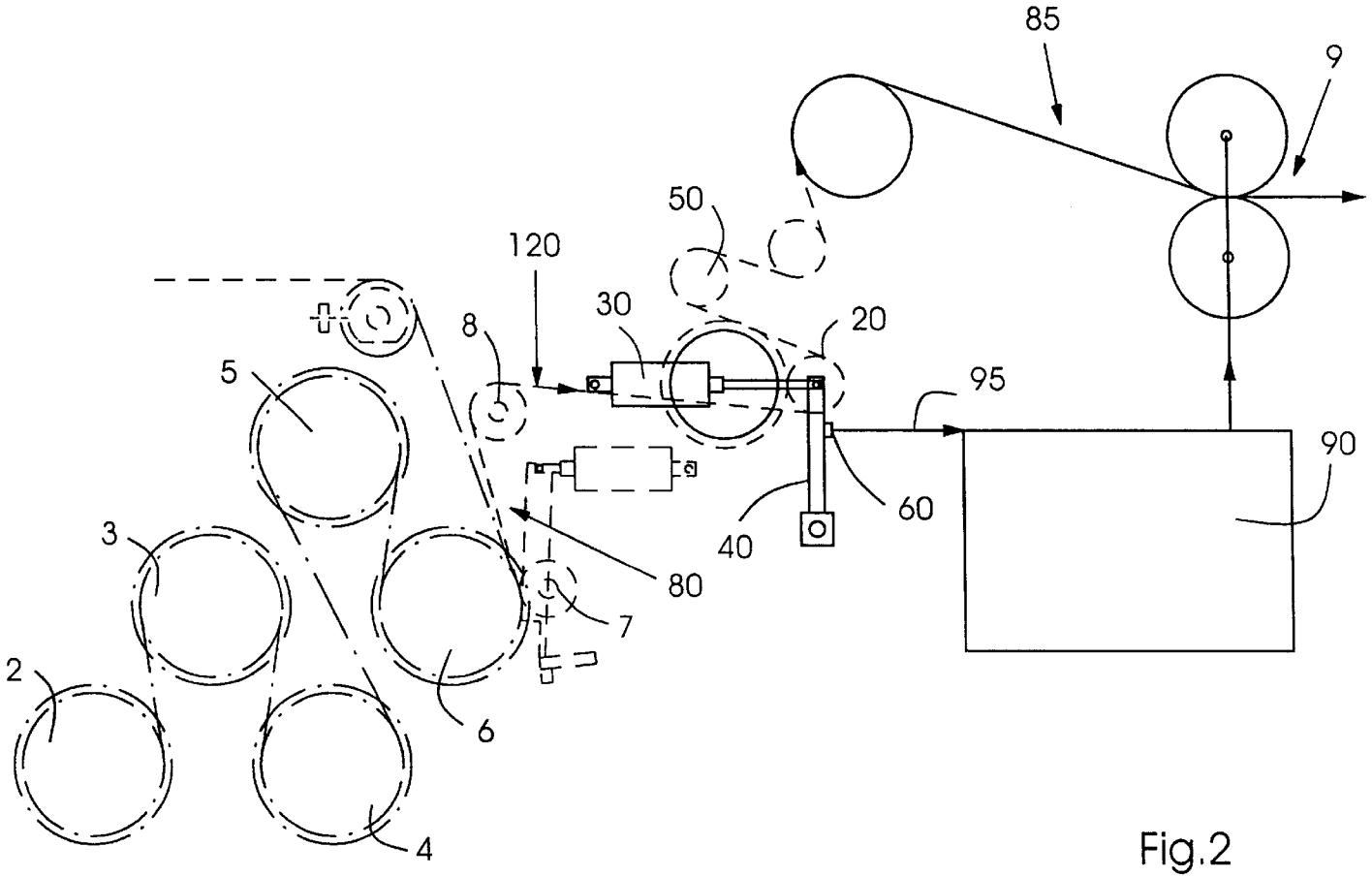
FIG. 2 shows a side view of a post chill region of a printing press including a dancer roll configuration according to a first embodiment of the present invention.

FIG. 2 shows a side view of a post chill region of a printing press including a dancer roll assembly according to a first embodiment of the present invention. The web 120 travels around a series of driven chill rolls 2, 3, 4, 5, and 6 which operate to cool the web 120. Each of the chill rolls is a driven roll. After entering the chill unit at roll 2 and traveling around the rolls 3, 4, and 5, the web 120 enters the chill unit exit nip, which is formed by the chill roll 6 and nip roll 7. The web 120 then passes an idler roll 8, a dancer roll 20, and an idler roll 50 before traveling to a downstream processing unit, for example, the slitter unit entrance nip 9.

The dancer roll 20 is mounted at its axis to both an air cylinder 30 and a lever arm 40. The air cylinder 30 is rotatably attached at its first end to the dancer roll and at its second end to the frame of the printing apparatus. The lever arm 40 is also rotatably attached at its first end to the dancer roll and at its second end to the frame of the printing apparatus. This configuration ensures that the dancer roll 20 moves along an arc having a radius equal to the length of the lever arm with a center at the point where the lever arm is attached to the frame.

The air cylinder 30 extends and retracts as governed by the load applied to the dancer roll 20 by the web 120. The air cylinder 30 operates at a constant pressure (P) which sets a specified load equal to the pressure (P) times the working area (A) of the cylinder. This specified load (PA) balances the load applied to the dancer roll 20 by the web, so that, when the web is not under tension or slack, the dancer roll 20 is maintained in a neutral position. There are no net forces on the dancer roll, that is, the forces balance and thus there is no acceleration of the dancer roll. When the web load on the dancer roll 20 decreases, the air cylinder 30 moves so that the corresponding motion of the dancer roll 20 takes out slack in the web 120 and raises the web load back to the specified load. When the web load increases, the air cylinder moves in the opposite direction so that the corresponding motion of the dancer roll 20 decreases the web load to the specified load.

A position sensor 60 is coupled between the lever arm 40 and a control unit 90. The control unit 90 controls the speed of the slitter unit entrance nip rolls 9 based upon the position of the lever arm 40.

Figure 3:
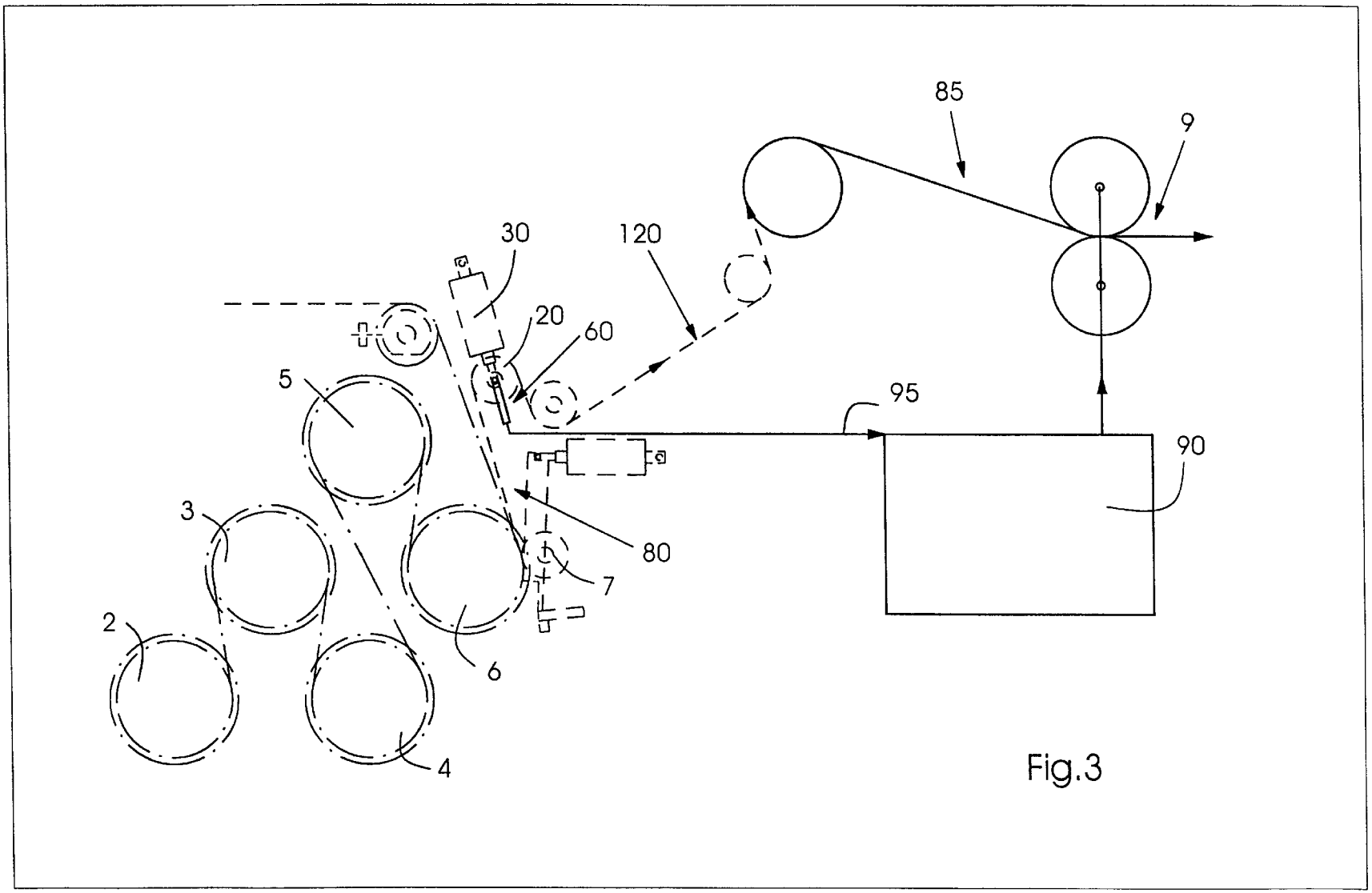
FIG. 3 shows a side view of the post chill region of printing press including a dancer roll configuration according to a second embodiment of the present invention.

When the portion of the web 120 exiting chill roll 3 (labeled position 80) is traveling at the same speed as the portion of the web 120 (labeled position 85) entering the slitter unit entrance nip 9, the dancer roll 20 occupies a neutral or home position as shown in FIG. 3. When the web speed at position 80 is greater than the web speed at position 85, the air cylinder 30 extends, moving the dancer roll 20 to eliminate a baggy web condition. When the web speed at position 80 is less than the web speed at position 85, the air cylinder 30 contracts to prevent tension in the web 120 from exceeding a threshold amount.

The position sensor 60, mounted on the lever arm 40, measures any deviation from the neutral position of the dancer roll 20, and transmits a deviation value 95 to the control unit 90. The position sensor might, for example, be configured to provide deviation values between 0.0 and −10.0 for corresponding incremental contractions of the air cylinder of, for example, 0 to −2, or 0 to −4 inches, and deviation values between 0.0 and +10.0 for corresponding incremental expansions of the air cylinder of, for example 0 to 2 or 0 to 4 inches. Of course, these values are only exemplary and the actual movement of the dancer roll will be dependent upon the physical dimensions of the device in accordance with the system to which it is applied. A linear voltage to distance transducer ("LVDT") may be adapted to provide the deviation value 95 based on the position of the dancer roll 20. However, as known by those skilled in the art, other sensors may be used for this purpose as well. As known in the art, the deviation value 95 can be any appropriate control signal, such as an analog voltage, impedance, a digital value, or other signal that the control unit 90 may be adapted to receive, with or without additional signal conditioning. In response to the deviation value 95 from the position sensor 60, the control unit 90 increases or decreases the speed of the slitter entrance nip rolls 9 required to return the dancer roll 20 to its neutral position.

Alternatively, the control unit 90 could increase or decrease the speed of the chill unit exit nip rolls 6, 7 to achieve a similar result, that is, to return the dancer roll 20 to its neutral or home position. According to a second alternative, the control unit 90 may increase or decrease the speed of either or both of the chill unit exit nip rolls 6, 7 or the slitter unit entrance nip rolls to restore the dancer roll 20 to its neutral position.

In general, the position of the dancer roll 20 is determined by the force balance on the dancer roll 20 expressed as $T_1+T_2=PA$, (assuming a 180° wrap of the web around the dancer roll 20, with no friction and neglecting mass), where $T_1$ is the tension of the web 120 entering the dancer roll 20, $T_2$ is the tension in the web 120 exiting the dancer roll 20, P is the pressure in the air cylinder 30, and A is the working area of the air cylinder 30. The position of the dancer roll 20 is related to the amount of paper traveling through the nips over a period of time.

If the chill unit exit nip 6, 7 moves an amount of paper $dl_1$ in time dt, and the slitter unit entrance nip 9 moves an amount $dl_2$ in the same period, the difference integrated over time gives an amount Δ1 that must be taken up by the dancer roll for the web tension to be maintained. The amount Δ1 is given by the equation:

$$\Delta 1=\int_0^t (dl_2/dt-dl_1/dt)dt \tag{1}$$

or $$\Delta 1=(l_2-l_1) \text{ at time } t \tag{2}$$

When the nip speeds at the chill unit exit nip rolls 6, 7 and the slitter unit entrance nip rolls 9 are substantially matched, for example, so that web strain is less than 0.01% of the span length, (slip is neglected, and radii are assumed constant), then:

$$dl_1=d\theta_1 r_1 \text{ AND } dl_2=d\theta_2 r_2 \tag{3}$$

and $$\Delta 1=\int_0^t [(d\theta_2/dt)r_2-(d\theta_1/dt)r_1]dt \tag{4}$$

or $$\Delta 1=\theta_2 r_2-\theta_1 r_1 \text{ at time } t. \tag{5}$$

However, if slip is appreciable, as it often is, then equation (5) does not provide an accurate representation, and equation (1) must be used.

Dancer rolls commonly have two modes of operation. The first mode is when the web is tight and therefore web tension is continuous over time. The second mode is when the web is loose. In this mode tension in the web is reduced and the web may be referred to as a baggy web.

In mode 1 operation, a light weight fast acting air cylinder 30 removes any cyclic variation in tension below a preselected cutoff frequency. The cutoff frequency is governed by physical properties of the dancer assembly such as the spring constant and damping factor of the air cylinder 30, and the mass of the dancer roll 20. For example, selecting an air cylinder 30 and a dancer roll 20 having a natural frequency of 10 Hertz may be suitable to accommodate variations in web tension in the 10 Hertz range. Depending on the physical and dynamic characteristics of the printing system, a higher or lower natural frequency of the dancer assembly may be required. In mode 1 operation, no appreciable motion is detected in the position of the dancer roll 20. In mode 2 operation, a highly mobile dancer roll 20 is required to absorb the Δ1 created in the web 120. When tension is stable in a web path, Δ1 represents the cumulative variation in the two roll speeds, as shown in equation 4.

During mode 1 operation, tension will normally be stabilized by the balance of forces on the dancer roll 20. However, during start up periods, for example, the dancer roll 20 may exhibit a transient response, wherein mass must be accelerated and tension is not stable. During these periods of operation, the speed of the chill unit exit nip rolls 6, 7 and slitter unit entrance nip rolls 9 are not matched well with respect to the web tension, and, as a result, the dancer roll 20 moves considerably. Web control is maintained primarily by the ability of the dancer roll 20 to maintain positive contact with the web 120 and establish a taut web i.e. not baggy. During transient periods, the strain in the web 120 contributes very little to the position of the dancer roll 20 and only the transport difference, $\theta_2 r_2 - \theta_1 r_1$, is important.

In accordance with the present invention, the change in position of the dancer roll 20 is used to control the speed of the slitter unit entrance nip rolls 9 and thereby tends to keep the dancer roll 20 in mode 1 operation. Defining error as the deviation of the dancer roll 20 from its home or neutral position, the integral of the error can be used to restore the dancer roll 20 to its home or neutral position so that Δ1 goes to 0. Suitable control algorithms for this purpose will be discussed more fully following explanations of further embodiments of the invention.

FIG. 3 shows a side view of a post chill region of a printing press including a dancer roll configuration according to a second embodiment of the present invention. Referring to FIG. 3, the web 120 passes around a dancer roll 20 which is mounted on an air cylinder 30. The air cylinder 30 is fixedly mounted to the frame of the printing apparatus such that the air cylinder shaft extends and retracts linearly, guiding the dancer roll 20 on a substantially linear path.

In this second embodiment, the air cylinder 30 extends in response to forces created by the web tension to alleviate the tension and prevent it from rising to a level that could lead to web breaks. The control unit 90, taking as input the deviation signal indicative of the position of the dancer roll 20, decreases the rotational speed of the slitter unit entrance nip rolls 9 in order to bring the dancer roll 20 back to its neutral position.

The air cylinder 30 retracts along its linear path when the tension in the web 120 falls below the specified load of the air cylinder 30. This retraction maintains a positive tension in the web 120 and may effectively take up slack in a baggy web. The control unit 90, using the retracted position of the dancer roll 20 as input, increases the rotational speed of the slitter unit entrance nip rolls 9 in order to bring the dancer roll 20 back to its neutral position.

Figure 4:
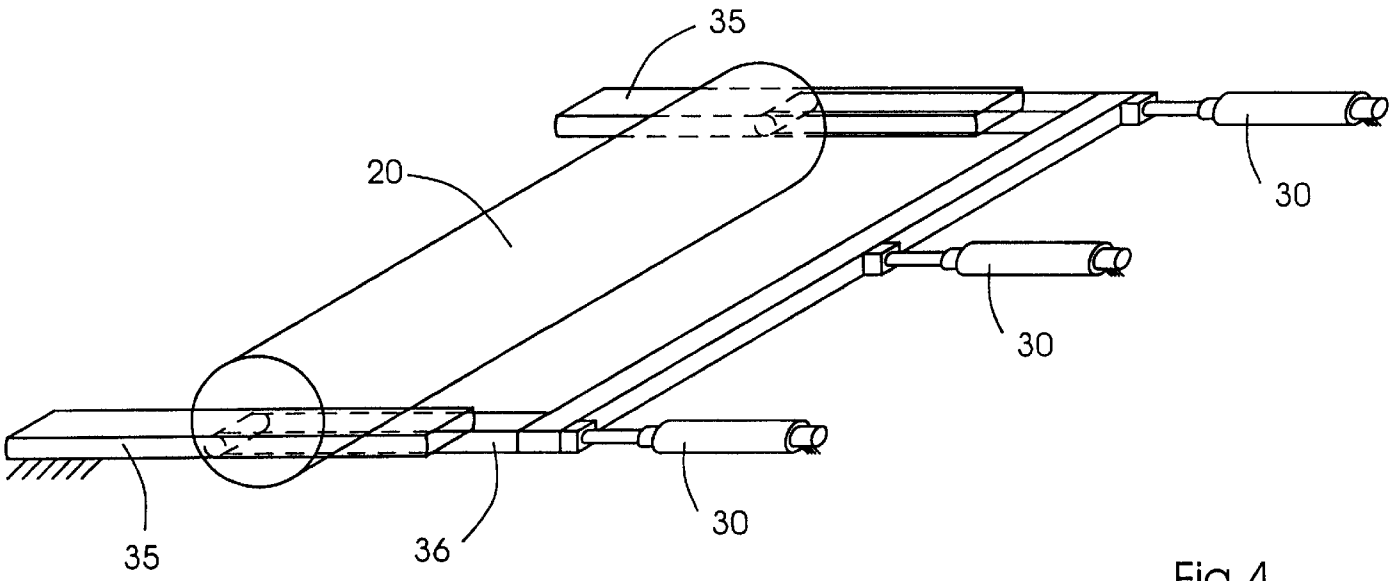
FIG. 4 shows a perspective view of a dancer roll 20 supported in linear tracks 35 attached to the frame of the printing apparatus.

As shown in FIG. 4, the dancer roll 20 is attached to a guide frame 36. The guide frame 36 has air cylinders 30 attached to it which provide a biasing force to maintain the dancer roll 20 in contact with the web 120. The guide frame 36 is adapted to travel within the linear tracks 35 in order to facilitate the linear movement of the dancer roll 20.

Figure 5:
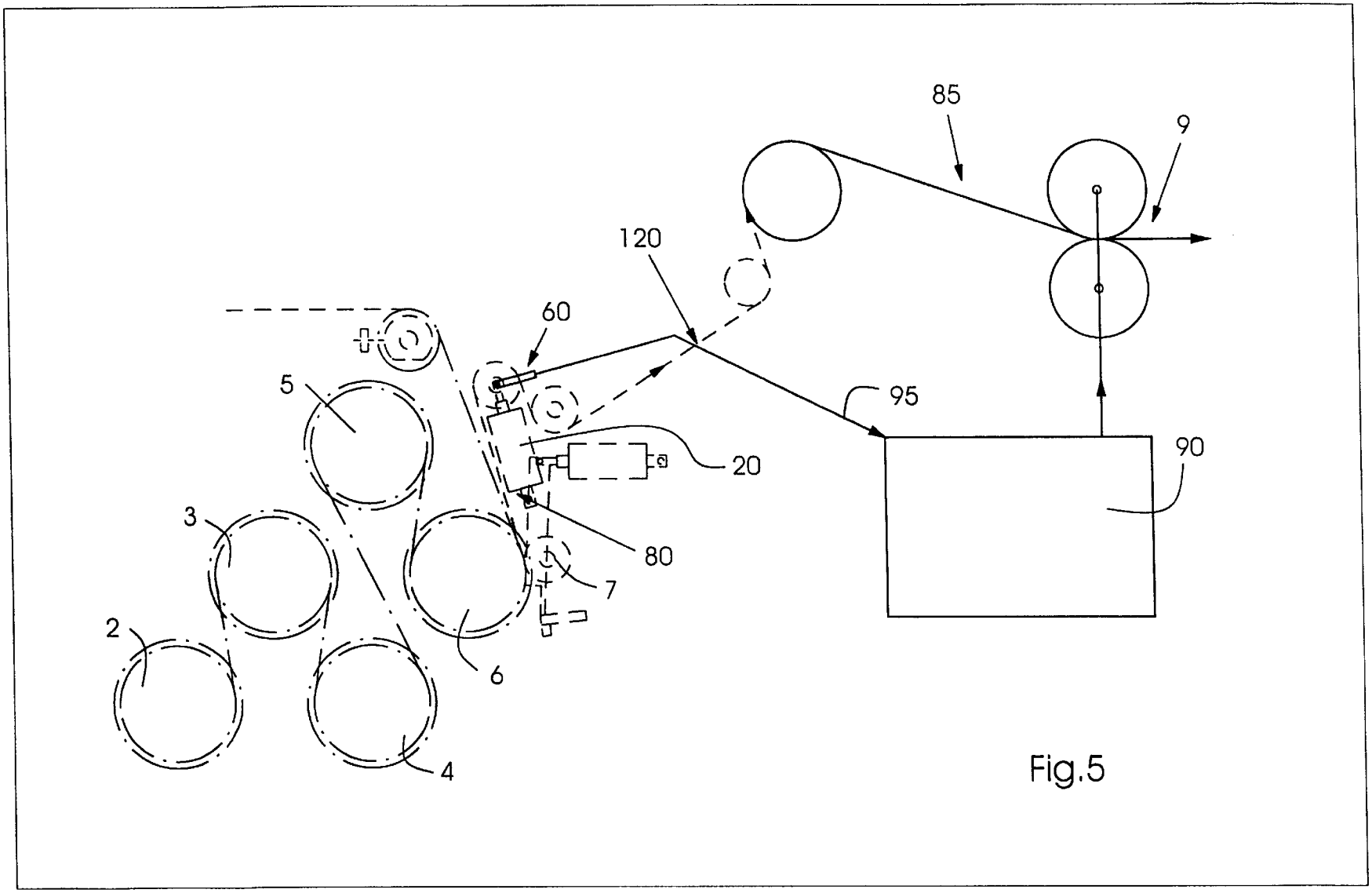
FIG. 5 shows a side view of the post chill region of a printing press including a dancer roll configuration according to a third embodiment of the present invention.

FIG. 5 shows a side view of a post chill region of a printing press including a dancer roll configuration according to a third embodiment of the present invention. Referring to FIG. 5, the dancer roll 20 is mounted to a free end of an air cylinder 30. As in the second embodiment, the air cylinder 30 is fixedly mounted to the frame of the printing apparatus such that the air cylinder shaft extends and retracts linearly, guiding the dancer roll 20 on a linear path. The linear tracks 35 and guide frame 36 as shown in FIG. 4 may be advantageously applied to the configuration of FIG. 5 as well. However, in contrast to the second embodiment, the air cylinder 30 extends in response to a decrease in web tension in order to maintain a positive tension in the web 120 and prevent baggy webs from developing. The air cylinder 30 retracts in response to an increase in web tension thereby preventing web tension from rising to a level that could lead to web breaks. The control unit 90 increases the rotational speed of the slitter unit entrance nip roll 9 in response to extension of the air cylinder 30, and decreases the rotational speed of the slitter unit entrance nip rolls 9 in response to retraction of the air cylinder 30.

As will be apparent to those of skill in the art, while the dancer roll 20 has been illustrated as being mounted on an air cylinder 30, other mechanisms may be used as force biasing elements. For example, alternatives that can be used to apply a force over a dynamically changing range of positions include springs, or masses hung from the radii of rolls.

The control unit 90 controls the ingoing nip or the outfeed nip rotational speed to control tension in the web. An algorithm to control slack in the web considers, for example, a web span of length l between an incoming nip and an outfeed nip. The outfeed nip has an outfeed gain with 0.5%. The web section has a maximum strain of 0.1%, a speed v, and some amount of unstretched paper s(0). This discussion is by way of example only and does not limit the invention to the embodiment discussed.

In any time interval t after t=0, the length of paper "in" is given by the web speed (v) multiplied by time (t), or vt. The length of paper "out" of the outfeed nip of 0.5% gain is 1.005 vt. The amount of unstretched paper stored at time t, s(t), is equal to the initial amount of slack paper, s(0), plus the amount of paper that came in minus the amount of paper that went out:

$$s(t)=s(\mathbf{0})+\mathrm{vt}-1.005\ vt$$

or $$s(t)=s(\mathbf{0})-0.005\ vt$$

The time to expel all the stored paper s(0) from the span (time for the stored paper s to go to zero, or the time for slack to be eliminated) would be:

$$t_{s-0}=s(\mathbf{0})/(0.005\ v)$$

For discussion purposes only and not limiting the invention, further assume a span length l of 25 feet and web speed v of 1500 fpm (25 feet/sec). Under these conditions, it might seem that the time to develop a strain of 0.001 is given by the linear relationship:

$$t_{(0.001)}=l*0.001/(0.005*v)$$

or $$t_{(0.001)}=0.2\ (l/v)=0.2\ \mathrm{sec}$$

However, this is incorrect because during each element of time that strain is being developed in the web span by the gain in the outgoing nip, an element of material with the new web span strain is being expelled from the outgoing nip, while a new unstrained element of material enters the incoming nip. Thus, the above linear method provides erroneous results.

Taking the non-linear factors into account leads to a first order differential equation with exponential solution $$s(t)=s(\infty)(1-e^{-(v/l)(t)})$$

where s(∞) is the final strain value. Since l/v is 1 second in this discussion, the strain rises to only 63.2% of its final value after 1 second. It requires nearly 3 seconds to rise to within 95% of the final value. As the solution is an exponential function, theoretically the final value is never reached. Fortunately, by making the nip gain 5 times that required to maintain the final strain, we speed up the process to arrive at the slipping nip operating gain in approximately 0.22 seconds.

Thus the time to develop "the nominal running stretch" of 0.1% (the maximum strain) is 0.22 sec for an "unstretched web" (i.e., an incoming web with zero strain), moving 1500 fpm (25 ft/sec) through a 25 foot span with a 0.5% gain. Although the erroneous linear method discussed above gave a result of 0.2 seconds, this is merely coincidental. For example, should the outfeed gain be reduced to 0.1%, then the time to reach 95% would increase to 3 seconds. The linear method erroneously provides a response time of 1 second when applying a 0.1% gain.

The stretch to be developed, for a 0.1% strain in a 25 foot web span, would be 0.001 times 25 feet or 0.025 feet or 0.3 inches. If, at the time the 0.3 inch stretch is developed, the outfeed gain is reduced to a level to maintain the stretch, the strain would remain at 0.1%. This gain would be 0.001. However, if the web 120 enters the incoming nip 6, 7 with the proper strain and the span strain is 0.001, then the outfeed nip 9 must match the speed of the incoming nip 6, 7 so that no additional strain is developed. Further, should the web 120 enter the incoming nip 6, 7 with a strain higher than the span strain of 0.1%, then the outfeed gain must be decreased below 0.001 to achieve the strain of 0.1%. This rather complex operation is usually achieved in web presses by simply allowing a slip to develop between the high gain pulling roll (in this case, nip 9) and the web 120 at the strain value to be maintained. When separate drives are employed on the nips, care must be exercised in setting the "transient gains" since the "natural nonlinear" transition to slip may or may not be present. This can cause confusion when attempting to optimize performance in the drive controller's response.

In summary, the time to remove one inch of stored unstretched web from any length web span having a nominal velocity of 25 ft/sec with an outfeed nip running 0.5% over speed is:

$$t(\mathbf{0})=1/12/v/\text{gain}$$

$$t(\mathbf{0})=1/12/25/0.005$$

$$t(\mathbf{0})=0.667\ \text{sec/inch}$$

However the time to develop 0.001 strain in a span with length equal to the web velocity is 0.22 or more seconds, as governed by the time constant, 1/v, and the gain.

Thus there are two clear mechanisms which govern the take up of the paper. The first is due to the difference between web speed in and web speed out under constant web strain. The second is the exponential development of a strain change due to a change in the web strain in and the web strain out.

Now consider placing a "perfect" dancer roll assembly in the web path to maintain a slight positive tension and no slack. Such a device would have a very tiny mass, very small diameter, very low inertia, with a very small spring or slight web opposing force component to just barely insure contact between the dancer roll and the web.

If such a dancer roll assembly were added to the web span to increase the web path to "take up the slack" s(0) and if the wrap around the dancer roll were approximately 180 degrees, the dancer roll would have to move ½ of the slack distance in order to store the slack.

To maintain a straight web path, the controller for such a system, in which the web wraps 180 degrees around the dancer roll, must sense the movement of the dancer roll and multiply it by 2 to find s. But if a slipping nip of 0.5% is involved and the objective is merely to take up the slack, then the controller does not need to do anything.

The built in gain will remove 1 inch per 0.667 seconds (at "0" strain) and then set the strain to 0.1% after another 0.22 seconds. Thus, after about 0.7 seconds this weightless dancer roll would have returned to its zero position, the web path would be straight and not include the dancer roll (the exact 25 feet) and the strain would start developing toward its 0.1% final value. Unfortunately, this dancer roll assembly could not correct for over strained conditions, i.e., strain greater than 0.1%, since there is no way to release paper from the straight path. The slipping nip is all that can provide this function.

Since such a "perfect" dancer roll assembly is unavailable and since the slipping nip is subject to uncontrolled behavior and to variations in the incoming web strain, the dancer roll and outfeed part of the system must be compensated to achieve the desired behavior. Limiting the maximum available gain of the system to small values, say two times the normal slipping value, insures low acceleration and kinetic energies ($\frac{1}{2}mv^2$) in the movement of the dancer roll. The kinetic energy of the dancer roll must be converted into potential energy ($\frac{1}{2}kx^2$) stored in the web if the dancer roll is to stop and if there is no damping. For illustrative purposes only, assume a 100 pound dancer roll moving at 0.6 inches per second. This provides a kinetic energy of $\frac{1}{2}(100/32.2)(0.6/12)^2=0.0039$ ft-lbs of energy. Further assuming a spring constant of 500 lbs per inch (assume 150 pounds causes 0.3 inches of stretch in a 50 inch wide web over a 25 foot span) then the amount the web 120 which must stretch to absorb the kinetic energy is $(2*0.0039/500*144)^{0.5}=0.047$ inch web stretch. This is about 16% of the normal web stretch from above. Because there will be some amount of dampening, this represents a maximum possible value. The dancer roll 20 moves only half this distance due to the wrap or 0.024 inches. Thus, the real value would be less.

The natural frequency of oscillation for this simple mass spring system is $(k/m)^{1/2}$ or $(500*12/100*32.2)^{1/2}=44.0$ rad/sec or 7.0 Hz. Thus, 0.14 sec is required for a complete cycle to occur.

If a dancer roll assembly had the capability to meet any travel requirements there would be no need to do more than provide the required space for travel. However, this is not practical, so even in the most simple dancer systems, some means of returning the dancer roll to a nominal operating position is required. A controller can be designed for this purpose so that the average position is fixed, but for short periods the dancer roll can freely move some reasonable distance.

The controller needs only to adjust the gain difference between the incoming nip and the outfeed to slowly move the dancer roll 20 back to its zero position. However this slow speed is greater than the lower limit set by the outfeed gain of 0.5%, i.e., not less than one inch in ⅔ of a second. It must also be fast enough to prevent the dancer roll 20 from hitting its maximum travel point. For simplicity and when allowed by low dynamic performance requirements (e.g., moving 1.5 inch/sec), it is normal to allow the controller gain to range from +0.5% to −0.5%, so that, combined with a built in mechanical gain of 0.5%, a doubling effect of the gain occurs in the low or slack tension condition. That is, the total gain (built-in mechanical gain plus the controller gain) ranges from 0.0 to 1.0%

A sample logic algorithm to achieve the desired control is shown, where the change in surface speed of the controlled nip roll is given as delta v:

```
Start
    t=0             "start a time measure"
    x=?             "measure dancer roll position"
If                  "check to see if the web is too loose"
    x < −0.05       "dancer roll is slack -- there is 0.1 inch of web stored"
    Then
        delta v=0       "surface speed = 1.005 web speed (i.e. assume a built
                        in gain of 0.5%"
        t=?             "provide a time base to judge what is happening"
        If
                        t < 0.1 sec     "wait for dancer roll to move"
                        Then
                            return to t=?       "wait some more"
        Else
                        Return to Start     "some measurable change should have
                                            occurred. Restart the process"
Else If             "check to see if the dancer roll is too tight"
    x > 0.05        "dancer roll is tight"
    Then
        delta v=2*0.005             "surface speed = .995 web speed assuming
                                    0.005 built in gain"
        t=?                         "provide a time base to judge what is
                                    happening
        If
                        t < 0.1 sec         "wait for dancer roll to move"
                        Then
                            return to t=?   "wait some more"
        Else
                        Return to start     "This is a continuous loop,
                                            running no slower than 1 cycle
                                            /0.1 seconds and maintaining the
                                            web slack or web path to + or −
                                            .1 inches.
End
```

In a more robust design, the incoming and outfeed nips may be at the same nominal speed, that is, the outfeed having no built in gain. The control algorithm would add to or subtract from the nominal speed an amount that on average maintains the dancer roll at the zero or neutral position. This is, for example, referred to as integral control. Since the size of the dancer roll motion is indicative of the amount of the strain error present, the gain can be adjusted to increase the correction rate accordingly.

A sample algorithm to implement such a control logic is:

```
Start
    n = 0                               "set the integrator to zero"
    delta v    = 0
    surface speed = 1.0 + delta v(n)     "increment the present value of surface
                                         speed by the current value of delta v"
    x=?                                  "measure dancer roll position"
If
    x < −0.05       "web slack is more than 0.1 inch in web path"
    Then
        t = 0                   "start a time measure"
        n = n+1                 "Count the movements (not used here, but can
                                be used in other designs)"
        gain = x/0.05*0.001     "For added response increase gain linearly
                                compared to the threshold value"
        delta v = delta v + gain        "add 0.1% gain to the nip speed for
                                        each time the dancer roll moves 0.05"
        If delta v > 1.005
            Then delta v = 1.005            "surface speed = sum of all
                                            prior corrections plus .001 web
                                            speed, but not greater than
                                            1.005"
        t=?     "check the wait time"
        If
            t < 0.1 sec     "wait for the dancer roll to move"
            Then
                return to t=?
        Else
            Return to surface speed
Else If
    x > 0.05    "dancer roll is tight, web has been stretched +.1 inch"
    Then
        t=0                     "start a time measure"
        n = n+1                 "Count the movements not used here, but can
                                be used in other designs"
```

-continued

```
        gain = x/.05*.001          "For added response, increase gain linearly
                                   compared to the threshold value"
        delta v = delta v − gain       "subtract 0.1% gain from the nip speed
                                       for each time the dancer roll moves .05
                                       inches from zero"
        If delta v > 0.995
            Then delta v = 0.995       "surface speed = sum of all
                                       prior corrections minus .001
                                       web speed surface speed, but not
                                       less than .995 web speed"
        t=?
        If
            t< 0.1 sec             "wait for dancer roll to move"
            Then
                return to t=?
        Else
            Return to surface speed
End
```

A constant force developing device, such as a pair of air cylinders 30 on either side of the dancer roll 20, can situate the dancer roll against the web 120 nearly all the time. The only time the dancer roll 20 would not be against the web 120 is if the dynamic oscillations of the dancer roll 20 were to completely relieve the web strain. For the physical parameters in the example discussed, oscillations of about 0.05 inches could cause such a result. The high damping of the cylinder and friction in the rotating components insure that this does not happen.

Implementation of the control system is not limited to the two control algorithms above, which were included as examples only. The discussion of specific embodiments discussed above are not exclusive to the invention. Those skilled in the art will recognize that there are many modifications to the disclosed embodiments which may be made without departing from the teachings of the invention which is to be limited only the claims appended hereto.

What is claimed is:

1. A device for controlling tension in a web received and processed by a printing apparatus, wherein the printing apparatus has a frame supporting at least one printing unit and a chill unit, wherein the web travels from an upstream end of the printing apparatus to a downstream end, the device comprising:

a dancer roll assembly mounted downstream of the chill unit between an incoming nip and an outfeed nip, the dancer roll assembly comprising:

a dancer roll movably coupled to the frame, the dancer roll being movable along an arc in a roughly horizontal plane; and a force biasing element, coupled between the dancer roll and the frame, wherein the force biasing element applies a force to the dancer roll to counteract a force applied to the dancer roll by the web in order to maintain the dancer roll in contact with the web;

a position sensor for sensing the position of the dancer roll; and a control unit coupled to the dancer roll, the position sensor, and at least one of the incoming nip and the outfeed nip, wherein, in response to a change in the position of the dancer roll, the control unit changes a rotational speed of at least one of the incoming nip and outfeed nip to thereby adjust the position of the dancer roll.

2. The device according to claim 1, wherein the position sensor provides to the control unit a deviation signal indicative of a distance between a current position of the dancer roll and a neutral position, whereby the control unit adjusts a speed of at least one of the incoming nip and the outfeed nip based upon the deviation signal.

3. The device according to claim 1, wherein the force biasing element comprises at least one air cylinder.

4. The device according to claim 1, wherein the dancer roll assembly further includes a lever arm having a first end rotatably coupled to the printing apparatus and a second end coupled to the dancer roll, the lever arm defining an arc of motion of the dancer roll having a radius substantially equal to a length of the lever arm and a center of rotation at the first end of the lever arm.

5. The device according to claim 1, wherein the incoming nip is a chill unit exit nip.

6. The device according to claim 1, wherein the outfeed nip is a slitter unit entrance nip.

7. The device according to claim 1, wherein the dancer roll assembly further includes a first idler roll rotatably fixed to the frame of the printing apparatus between the incoming nip and the dancer roll.

8. A device for controlling tension in a web received and processed by a printing apparatus, wherein the printing apparatus has a frame supporting at least one printing unit and a chill unit, wherein the web travels from an upstream end of the printing apparatus to a downstream end, the device comprising:

a dancer roll assembly mounted downstream of the chill unit between an incoming nip and an outfeed nip, the dancer roll assembly comprising:

a dancer roll movably coupled to the frame; and a force biasing element, coupled between the dancer roll and the frame, wherein the force biasing element applies a force to the dancer roll to counteract a force applied to the dancer roll by the web in order to maintain the dancer roll in contact with the web;

a position sensor for sensing the position of the dancer roll; and a control unit coupled to the dancer roll, the position sensor, and at least one of the incoming nip and the outfeed nip, wherein, response to a change in the position of the dancer roll, the control unit changes a rotational speed of at least one of the incoming nip and outfeed nip to thereby adjust the position of the dancer roll;

wherein the control unit controls at least one of the incoming nip and the outfeed nip rotational speed based on an error signal governed by the equation $\Delta 1=\theta_2 r_2-\theta_1 r_1$ where $\Delta 1$ is the difference in a length of web traveling through the incoming nip and a length of web traveling through the outfeed nip; $\theta_2 r_2$ is a length of web traveling through the outfeed nip; and $\theta_1 r_1$ is a length of web traveling through the incoming nip.

9. The device according to claim 8, wherein the dancer roll assembly further includes a second idler roll rotatably fixed to the frame between the dancer roll and the outfeed nip.

10. A device for controlling tension in a web received and processed by a printing apparatus, wherein the printing apparatus has a frame supporting at least one printing unit and a chill unit, wherein the web travels from an upstream end of the printing apparatus to a downstream end, the device comprising:

a dancer roll assembly mounted downstream of the chill unit between an incoming nip and an outfeed nip, the dancer roll assembly comprising:

a dancer roll movably coupled to the frame; and a force biasing element, coupled between the dancer roll and the frame, wherein the force biasing element applies a force to the dancer roll to counteract a force applied to the dancer roll by the web in order to maintain the dancer roll in contact with the web;

a position sensor for sensing the position of the dancer roll; and a control unit coupled to the dancer roll, the position sensor, and at least one of the incoming nip and the outfeed nip, wherein, in response to a change in the position of the dancer roll, the control unit changes a rotational speed of at least one of the incoming nip and outfeed nip to thereby adjust the position of the dancer roll;

wherein the control unit includes means for detecting a gain difference between the incoming nip and the outfeed nip and wherein the control unit controls the rotational speed of at least one of the incoming nip and the outfeed nip based on an algorithm which adjusts a gain difference between the incoming nip and the outfeed nip to thereby maintain the dancer roll in a neutral position.

11. A device for controlling tension in the web of a printing apparatus, wherein the printing apparatus includes a chill unit and a slitter unit, the device comprising:

a dancer roll assembly adjustably mounted between an exit nip of the chill unit and an entrance nip of the slitter unit, the web being engaged with the dancer roll assembly; and a control unit coupled to the dancer roll for detecting a change in position of the dancer roll, and, in response to the change in position, adjusting a rotational speed of one of the chill unit exit nip and the slitter unit entrance nip to maintain a substantially constant tension in the web.

* * * * *